US005887444A

United States Patent [19]

Toyoshima et al.

[11] Patent Number: 5,887,444

[45] Date of Patent: Mar. 30, 1999

[54] ACCUMLATOR

[75] Inventors: Masaki Toyoshima; Hitoshi Iijima; Naoki Tanaka; Toshihide Koda; Mihoko Shimoji, all of Tokyo, Japan

[73] Assignee: Mitsubishi Denki Kabushiki Kaisha, Tokyo, Japan

[21] Appl. No.: 895,042

[22] Filed: Jul. 16, 1997

[30] Foreign Application Priority Data

Nov. 6, 1996 [JP] Japan ..... 8-293783

[51] Int. Cl.[6] ..... F15B 1/02

[52] U.S. Cl. ..... 62/192; 62/471; 62/503

[58] Field of Search ..... 62/192, 193, 470, 62/471, 503

[56] References Cited

U.S. PATENT DOCUMENTS 4,231,230 11/1980 Gratzer et al. ..... 62/503
4,757,696 7/1988 Gannaway ..... 62/503
5,201,792 4/1993 Study ..... 62/503
5,347,817 9/1994 Kim ..... 62/471

FOREIGN PATENT DOCUMENTS 57-17187 4/1982 Japan .
62-52230 11/1987 Japan .

*Primary Examiner*—Harry B. Tanner
*Attorney, Agent, or Firm*—Burns, Doane, Swecker & Mathis, LLP

[57] ABSTRACT

In an accumulator constituting a refrigerating cycle apparatus, a high liquid-level auxiliary pipe (14*a*) and a low liquid-level auxiliary pipe (14*b*), which act as oil recovery pipes, and each of which is provided with a plurality of oil recovery holes (10*a*), are attached to a discharge pipe (12) in positions so as to be different vertically from each other, so that lubricating oil can be surely recovered through the oil recovery holes.

16 Claims, 6 Drawing Sheets

ACCUMLATOR

BACKGROUND OF THE INVENTION

The present invention relates to an accumulator constituting an air-conditioner or the like using refrigeration oil having very low or no solubility with a refrigerant or having solubility with a characteristic mutually separable from a refrigerant in accordance with temperature conditions.

A general refrigerating cycle is constituted by a compressor 1, a condenser 2, a decompressor 3, an evaporator 4, and an accumulator 5 which are connected circularly by piping as shown in FIG. 6.

For example, in a well-known accumulator 5 disclosed in JP-B-57-17187 and JP-B-62-52230, a suction pipe 11 and a discharge pipe 12 are attached to the intermediate portion and bottom portion of a cylindrical closed vessel 13 respectively, as shown in FIG. 7. One of the openings of the discharge pipe 12 is projected into the cylindrical closed vessel 13 and is provided with an oil recovery hole 10 at a position near a portion where the discharge pipe 12 penetrates the cylindrical closed vessel 13.

Because the conventional accumulator is arranged thus, a mixture of lubricating oil and refrigerant liquid collected in the bottom of the cylindrical closed vessel 13 is sucked into the discharge pipe 12 through the oil recovery hole 10, and sent to the compressor 1.

In addition, in a general refrigerating cycle system, the accumulator is provided before the suction side of the compressor, and required to perform gas-liquid separation of a gas-liquid mixture refrigerant to thereby prevent the compressor from sucking liquid refrigerant, and to return the lubricating oil of the compressor flowing together with the refrigerant to the compressor smoothly without leaving the lubricating oil staying in the accumulator.

In the accumulator 5 shown in FIG. 7 which constitutes such a conventional refrigerating cycle as shown in FIG. 6, a liquid mixture of liquid refrigerant and lubricating oil collected in the bottom of the accumulator has a tendency that a layer rich in the lubricating oil is collected in an upper portion while a layer rich in the liquid refrigerant is collected in a lower portion, particularly at a low temperature, in accordance with the relationship of specific gravities of the both components. Therefore, there has been a fear that only the liquid refrigerant is sucked through the oil recovery hole in accordance with the vertical position of the liquid level of the liquid mixture, and the lubricating oil does not return to the compressor, thereby causing damage in the compressor due to abrasion.

Description has been made above on the assumption that the refrigerant and the lubricating oil are dissolved with each other in the accumulator 5. In the case where the refrigerant is not dissolved in the lubricating oil at all, or has very low solubility in the lubricant oil, the refrigerant and the lubricating oil are separated perfectly in the accumulator 5 so that the lubricating oil is collected in the upper layer side of the liquid refrigerant based on the relationship of specific gravities of the two components, and the lubricating oil does not return to the compressor so long as the lubricating oil comes to the position of the oil recovery hole 10. Accordingly there has been a fear that the lubricating oil stays in the accumulator a, thus causing damage in the compressor.

SUMMARY OF THE INVENTION

The present invention has been achieved to solve the foregoing problems, and it is an object of the present invention to provide an accumulator and a refrigerating cycle, in which the diameter of an oil recovery hole is processed to be large enough to have no problem in processing, so that refrigerant gas and lubricating oil are sucked into a compressor efficiently without leaving the lubricating oil in the accumulator even when the lubricating oil and the refrigerant are soluble in each other or when the refrigerant is not soluble in the lubricating oil at all, so that failure in lubrication is prevented from occurring. Thus, the reliability of the compressor is ensured, and the compressor is prevented from being broken.

In order to attain the above object according to a first aspect of the present invention, an accumulator is provided comprising: a closed vessel for storing a refrigerant which circulates in a refrigerating cycle; a suction pipe for introducing the refrigerant into the closed vessel; a discharge pipe for discharging the refrigerant from the closed vessel; first and second oil recovery pipes each of which is held in the closed vessel and has a plurality of oil recovery holes formed in the vertical direction; and a communicating port through which the lower portions of the oil recovery pipes communicate with the discharge pipe.

In the above accumulator according to the first aspect of the present invention, preferably, the first and second recovery pipes are provided in the vertical direction, and provided so as to be different in positions of the oil recovery holes from each other.

Preferably, the above accumulator according to the first aspect of the present invention further comprises a valve which is provided in one of the first and second oil recovery pipes having the oil recovery holes disposed in positions lower than those of the other one of the first and second oil recovery pipes, so that the control valve controls a flow of oil to be returned to a compressor in accordance with running conditions of the compressor.

According to a second aspect of the present invention, an accumulator is provided comprising: a closed vessel for storing a refrigerant which circulates in a refrigerating cycle; a suction pipe for introducing the refrigerant into the closed vessel; a discharge pipe for discharging the refrigerant from the closed vessel; an oil recovery pipe held in the closed vessel and having a plurality of oil recovery holes formed in the vertical direction; a communicating port through which a lower portion of the oil recovery pipe communicates with the discharge pipe; and a control valve provided in the oil recovery pipe for controlling a flow of oil to be returned to a compressor in accordance with running conditions of the compressor.

In the above accumulator according to the second aspect of the present invention, preferably, the control valve performs control in accordance with an outflow of oil from the compressor.

According to a third aspect of the present invention, an accumulator is provided comprising: a closed vessel for storing a refrigerant which circulates in a refrigerating cycle; a suction pipe for introducing the refrigerant into the closed vessel; an oil reservoir provided at an inside lower portion of the closed vessel so as to be communicatable at an lower portion of the oil reservoir with the closed vessel; an oil recovery pipe held in the oil reservoir for sucking the refrigerant out of the closed vessel through a plurality of oil recovery holes formed in the vertical direction, and introducing the refrigerant into the oil reservoir; a discharge pipe fixed in the closed vessel for discharging the refrigerant dispersed in the closed vessel, and having an oil recovery hole formed inside the oil reservoir.

Preferably, the above accumulator according to the third aspect of the present invention further comprises a driving means for sucking the refrigerant out of the closed vessel through the oil recovery pipe and introducing the refrigerant to the oil reservoir.

In the above accumulator according to the third aspect of the present invention, preferably, the oil reservoir is provided above the oil recovery hole of the discharge pipe, and has a hole communicating with the closed vessel.

In the above accumulator according to the third aspect of the present invention, preferably, the driving means is provided outside the closed vessel.

In the above accumulator according to the third aspect of the present invention, preferably, the driving means is driven by a flow of the refrigerant discharged from the suction pipe.

In the above accumulator according to any of the first, second and third aspects of the present invention, preferably, the discharge pipe is provided with a filter for recovering foreign matters.

DETAILED DESCRIPTION OF THE PREFERRED EMBODIMENTS

Embodiment 1

The present invention relates to an accumulator constituting a refrigerating cycle or a refrigerating/air-conditioning circuit.

Figure 1:
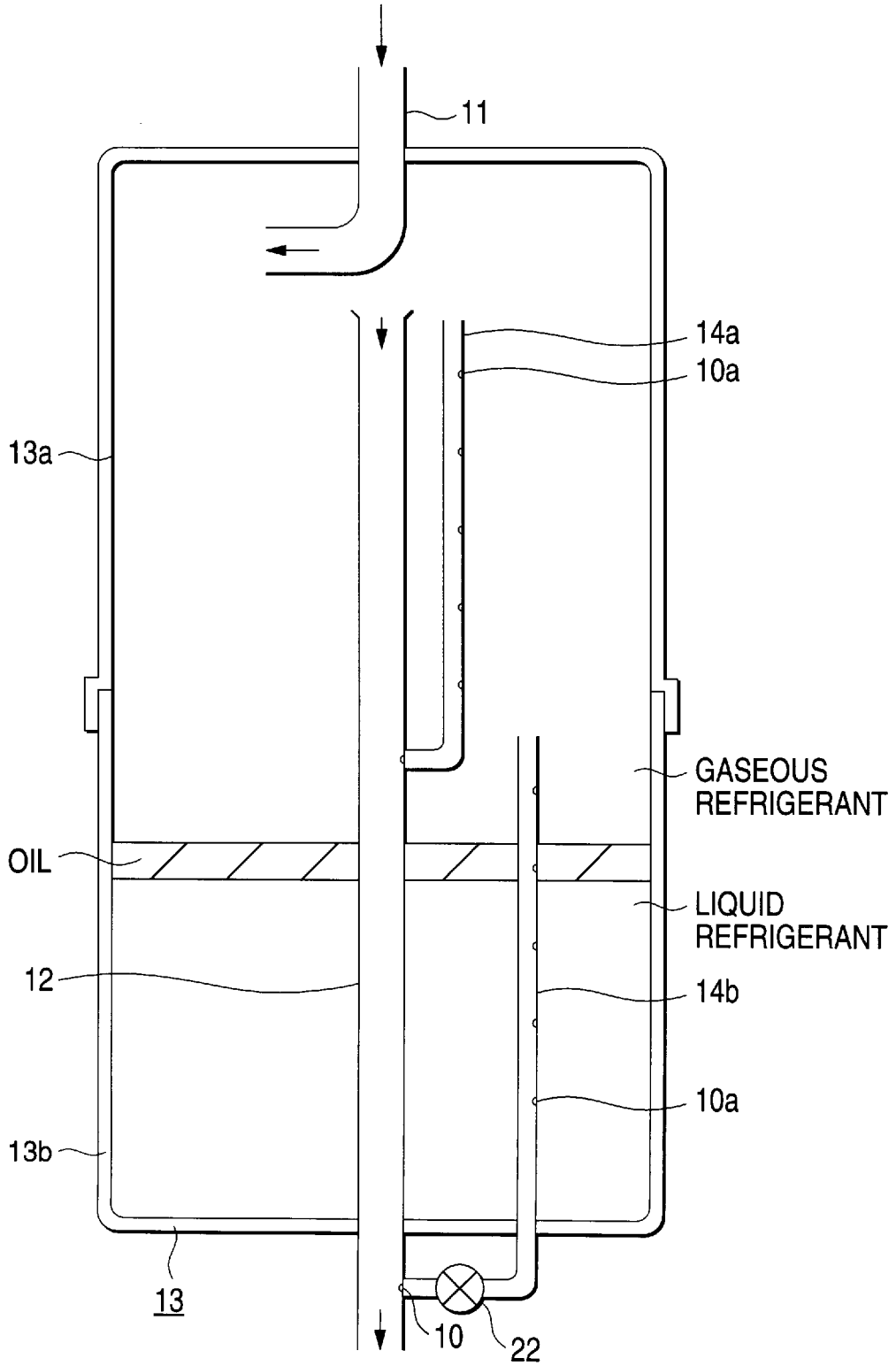
FIG. 1 is a diagram of an accumulator showing Embodiment 1.

An embodiment will be described with reference to FIG. 1. In FIG. 1, a high liquid-level auxiliary pipe 14*a* and a low liquid-level auxiliary pipe 14*b*, which act as oil recovery pipes, are attached to a discharge pipe 12. More specifically, for example, the discharge pipe 12 has two oil discovery holes 10 formed, as communication ports, so as to be different in height from each other, and the auxiliary pipes 14*a* and 14*b* are connected at their lowermost end portions to the oil recovery holes 10 respectively. Each of the auxiliary pipes 14*a* and 14*b* has a plurality of oil recovery holes 10*a*. Although the auxiliary pipes 14*a* and 14*b* are illustrated in FIG. 1 so as to be connected at their lowermost portions to the two oil recovery holes 10 of the discharge pipe 12 respectively, the positions of connection of the auxiliary pipes 14*a* and 14*b* to the discharge pipe 12 are not limited to their lowermost portions but may located at any positions so long as the connecting positions are in their lower portions. In addition, although the communicating ports, that is, the oil recovery holes 10 are provided by two in number for the two auxiliary pipes 14*a* and 14*b* in FIG. 1, only one communication port may be provided for the two auxiliary pipes 14*a* and 14*b*. An electrically-driven flow control valve 22 for detecting the liquid level to thereby control the flow is attached in the low liquid-level auxiliary pipe 14*b* at a position a little before the connection portion of the auxiliary pipe 14*b* to the discharge pipe 12. Although the electrically-driven flow control valve 22 is provided outside a cylindrical closed vessel 13 so as to be easy in handling, it may be provided inside the cylindrical closed vessel 13. In addition, the oil recovery holes 10 may be disposed either inside or outside the closed vessel 13. In addition, the oil recovery holes 10, 10*a* and 10*b* are circular basically, but they are not always limited to be circular.

Next, the operation will be described. Wet refrigerant flows into the cylindrical closed vessel 13 from the suction pipe 11, and liquid refrigerant and lubricating oil are collected. When the lubricating oil having low solubility in the refrigerant and having a specific gravity smaller than that of the liquid refrigerant is separated to float on the liquid refrigerant, or when a layer rich in the lubricating oil is collected in the upper layer portion and a layer rich in the liquid refrigerant is collected in the lower layer portion at a low temperature or the like even in the case of oil having high solubility in the refrigerant, the floating oil is recovered from either the low liquid-level auxiliary pipe 14*a* or the high liquid-level auxiliary pipe 14*b* to thereby ensure the reliability of the compressor, and prevent the compressor from being broken.

The ratio of the flow of the liquid refrigerant to the flow of the refrigerator oil (lubricating oil) will be described. In such an auxiliary pipe acting as an oil recovery pipe, the longer the oil recovery pipe is, the less refrigerator oil returns to the compressor (the more the liquid refrigerant is returned). Therefore, the oil recovery pipe is divided into the upper and the lower ones 14*a* and 14*b* herein.

Thus, in this embodiment, the two auxiliary pipes 14*a* and 14*b* for high and low liquid levels are provided, and a desired one of the pipes may be used selectively in accordance with the liquid level. Therefore, in comparison with the case where only one auxiliary pipe deals with any liquid level, it is possible to reduce the quantity of liquid refrigerant returning to the compressor even at the time of high liquid level. Accordingly, there is an effect that the necessary quantity of oil for the compressor can be ensured, and liquid compression due to excessive returning of the liquid refrigerant can be prevented.

Embodiment 2

Figure 2:
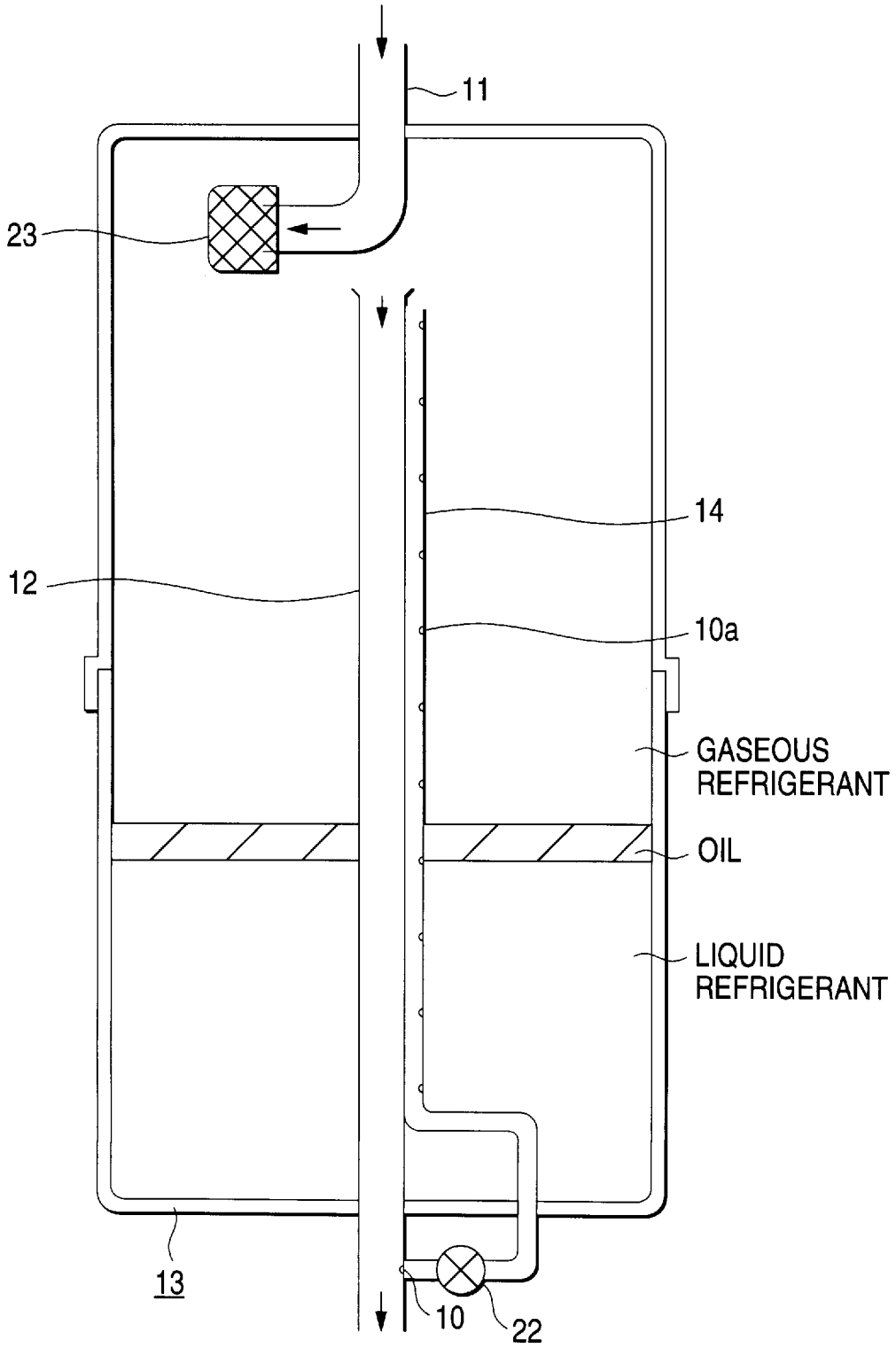
FIG. 2 is a diagram of an accumulator showing Embodiment 2.

A second embodiment will be described with reference to FIG. 2. In FIG. 2, an auxiliary pipe 14 provided with a plurality of oil recovery holes 10*a* is attached (communicates) to a discharge pipe 12 so as to communicate therewith, and an electrically-driven flow control valve 22 for controlling the flow is attached to the auxiliary pipe 14 which acts as an oil recovery pipe. Although the electrically-driven flow control valve 22 is provided outside a cylindrical closed vessel 13 so as to be easy in handling, it may be provided inside the cylindrical closed vessel 13. In addition, the auxiliary pipe 14 is soldered to be fixed with the discharge pipe 12 so that the auxiliary pipe is prevented from being broken by vibrations of the compressor or the like.

In addition, a filter 23 for recovering foreign matters such as metal pieces or the like is attached to the suction pipe 11 to prevent the oil recovery holes 10*a* and an oil recovery hole 10 from being blocked.

Next, the operation will be described. Wet refrigerant flows into the cylindrical closed vessel 13 from the suction pipe 11, and liquid refrigerant and lubricating oil are collected in the vessel. When the lubricating oil is separated to float on the liquid refrigerant, the floating oil is recovered through any of the oil recovery holes 10*a*. In this embodiment, the electrically-driven flow control valve 22 is attached to the auxiliary pipe 14 and the opening thereof is made large to increase the capacity of recovering the oil and reduce the quantity of oil staying in the cylindrical closed vessel 13 to thereby ensure the quantity of oil required for the compressor in the condition where the compressor is driven at a high frequency so that the outflow of the oil from the compressor is increased at the start of the compressor or during the operation of the compressor with a high load, for example, when the internal pressure of the accumulator is so high that the density of the refrigerant sucked into the compressor becomes large to increase the load to the compressor. In the case where the compressor is operated at a low frequency for example at the time of driving with a low load, on the contrary, the opening of the electrically-driven flow control valve 22 is made small in order to suppress the quantity of returned liquid refrigerant to be as small as possible so long as the quantity of the oil necessary to be returned to the compressor is ensured, because the outflow of the oil from the compressor is low. Since the quantity of the lubricating oil returned to the compressor can be controlled in this manner, it is possible to return the oil in accordance with the running conditions of the compressor, so that there is an effect to ensure the reliability of the compressor and prevent the compressor from being broken.

Embodiment 3

Figure 3:
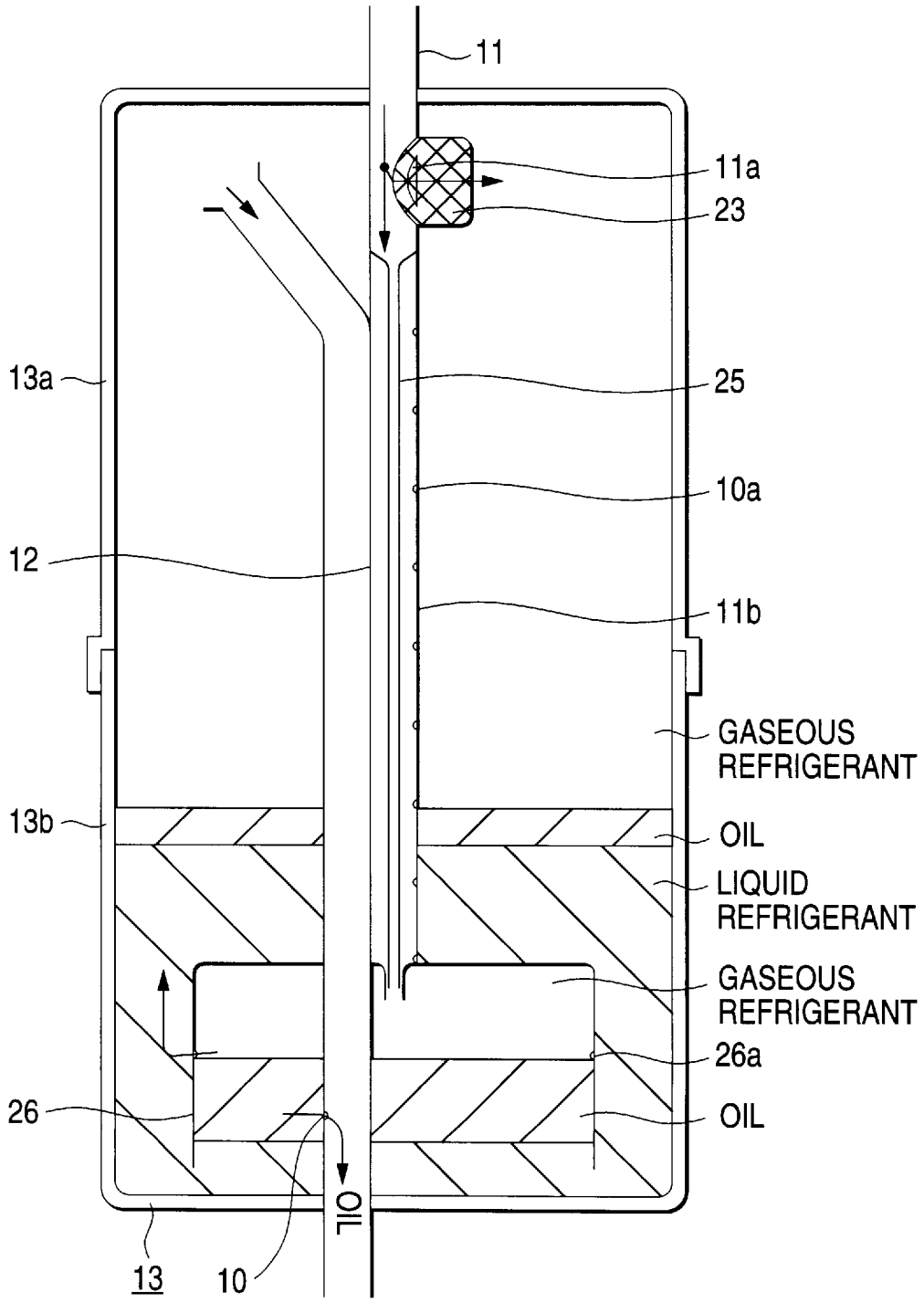
FIG. 3 is a diagram of an accumulator showing Embodiment 3.

A third embodiment will be described with reference to FIG. 3. In FIG. 3, a suction pipe 11 is designed to have a double-pipe structure on the way, so that sucked refrigerant is branched to two directions, that is, to a refrigerant suction hole 11*a* opened in the upper side surface of the suction pipe 11, and to an double-pipe inner pipe 25. In addition, a plurality of oil recovery holes 10*a* are provided in a double-pipe outer pipe 11*b* which acts as an oil recovery pipe of the suction pipe. The suction pipe 11 and a discharge pipe 12 are connected to each other at their outer walls by soldering. At a portion lower than this connection portion, an oil reservoir vessel 26 is connected to the two pipes by soldering. Although the vessel 26 having an inverted-cup shape is shown in FIG. 3, by way of example, as oil reservoir means for circulating oil surely, it is not limited to this so long as it has an oil reservoir portion. By connecting the suction pipe-11, the discharge pipe 12 and the oil reservoir vessel 26 to each other, the respective parts are also fixed to a cylindrical closed vessel 13. Accordingly, special parts for fixation are not required, so that it is possible to reduce the number of parts, and simplify the manufacturing process. The lower portion of the suction pipe 11 is reduced so as to draw the lubricating oil into the oil reservoir vessel 26 by use of the dynamic pressure of the sucked refrigerant. The oil reservoir vessel 26 has gas refrigerant vent holes 26*a*, and the discharge pipe 12 has an oil recovery hole 10. In addition, a filter 23 is attached to the refrigerant suction pipe 11*a* so as to recover foreign matters such as metal pieces to thereby prevent oil recovery holes 10*a* and the oil recovery hole 10 from being blocked.

Next, the operation will be described. The flow of wet refrigerant flowing into the cylindrical closed vessel 13 from the suction pipe 11 is branched into two directions, that is, to the suction hole 11*a* and to the double-pipe inner pipe 25. At this time, the ratio of the flow in the suction hole 11*a* to the flow in the double-pipe inner pipe 25 is designed so that the flow in the suction hole 11*a* is larger than the latter. The flow into the double-pipe inner pipe 25 is reduced so that the oil surface formed in the oil reservoir vessel 26 is not waved excessively. In such a flow ratio, the minimum flow of lubricating oil requirement to be drawn is sent into the oil reservoir vessel 26 by the dynamic pressure of the sucked refrigerant. This flow ratio is determined by the hole diameter of the suction hole 11*a* and the pipe diameter of the double-pipe inner pipe 25.

When the lubricating oil is smaller in specific gravity than the liquid refrigerant so that the lubricating oil is separated to float on the liquid refrigerant, the oil and the liquid refrigerant in the oil recovery pipe 11*b* can be drawn and recovered into the oil reservoir vessel 26 surely, and the oil can be returned to the compressor surely. Thus, the reliability of the compressor can be ensured, and the compressor can be prevented on being broken. The diameter of the double-pipe inner pipe 25 is designed so as to be able to use enough dynamic pressure to introduce the oil in the double-pipe inner pipe 25 into the oil reservoir vessel 26.

When the liquid refrigerant and the lubricating oil are collected in the cylindrical closed vessel 13, and the lubricating oil is smaller in specific gravity than the liquid refrigerant so that the lubricating oil is separated to float from the liquid refrigerant, the floating oil is drawn and recovered into the oil reservoir vessel 26 through any of the oil recovery holes 10*a*. The oil is drawn into the oil reservoir vessel 26 together with the liquid refrigerant and the gas refrigerant by the dynamic pressure of the sucked refrigerant flowing in the double-pipe inner pipe 25. An oil layer is formed in the oil reservoir vessel 26, and surplus gas refrigerant is discharged into the cylindrical closed vessel 13 through the gas refrigerant vent holes 26*a*. In addition, the gas refrigerant vent holes 26*a* are disposed in the side portion of the oil reservoir vessel. As a result, the oil level is kept almost constant. The diameter of the hole 26*a* is made not smaller than the diameter of the inner pipe 25. Between the outlet of the double-pipe inner pipe 25 and the oil-surface forming height of the gas refrigerant vent holes 26*a* from the bottom surface of the cylindrical closed vessel 13, a certain distance is provided so that waving of the oil surface formed in the oil reservoir vessel 26 can be reduced to the lowest degree. As for the positional relationship between the gas refrigerant vent holes 26*a* and the oil recovery hole 10, the gas refrigerant vent holes 26*a* are disposed in positions higher than the oil recovery hole 10, so that the oil is returned to the compressor through the oil recovery hole 10 from the oil layer formed in the oil reservoir vessel 26. With this structure, the flow of the oil returned to the compressor is increased, so that the reliability of the compressor can be ensured, and the compressor can be prevented from being broken. Then, the oil recovery hole 10 is disposed at a height near the lower portion of the oil reservoir vessel 26.

Next, the manufacturing procedure will be described. First, the suction pipe 11, the discharge pipe 12 and the oil reservoir vessel 26 are connected to each other in advance so as to produce an integrated assembly. Next, this integrated assembly and a cylindrical closed vessel lower portion 13*b* are connected to each other, and thereafter the cylindrical closed vessel upper portion 13*a* is connected to the vessel lower portion 13*b*. The cylindrical closed vessel upper and lower portions 13*a* and 13*b* are punched in advance. Since those parts integrated in advance can be assembled thus, it is possible to simplify the manufacturing process.

Embodiment 4

Figure 4:
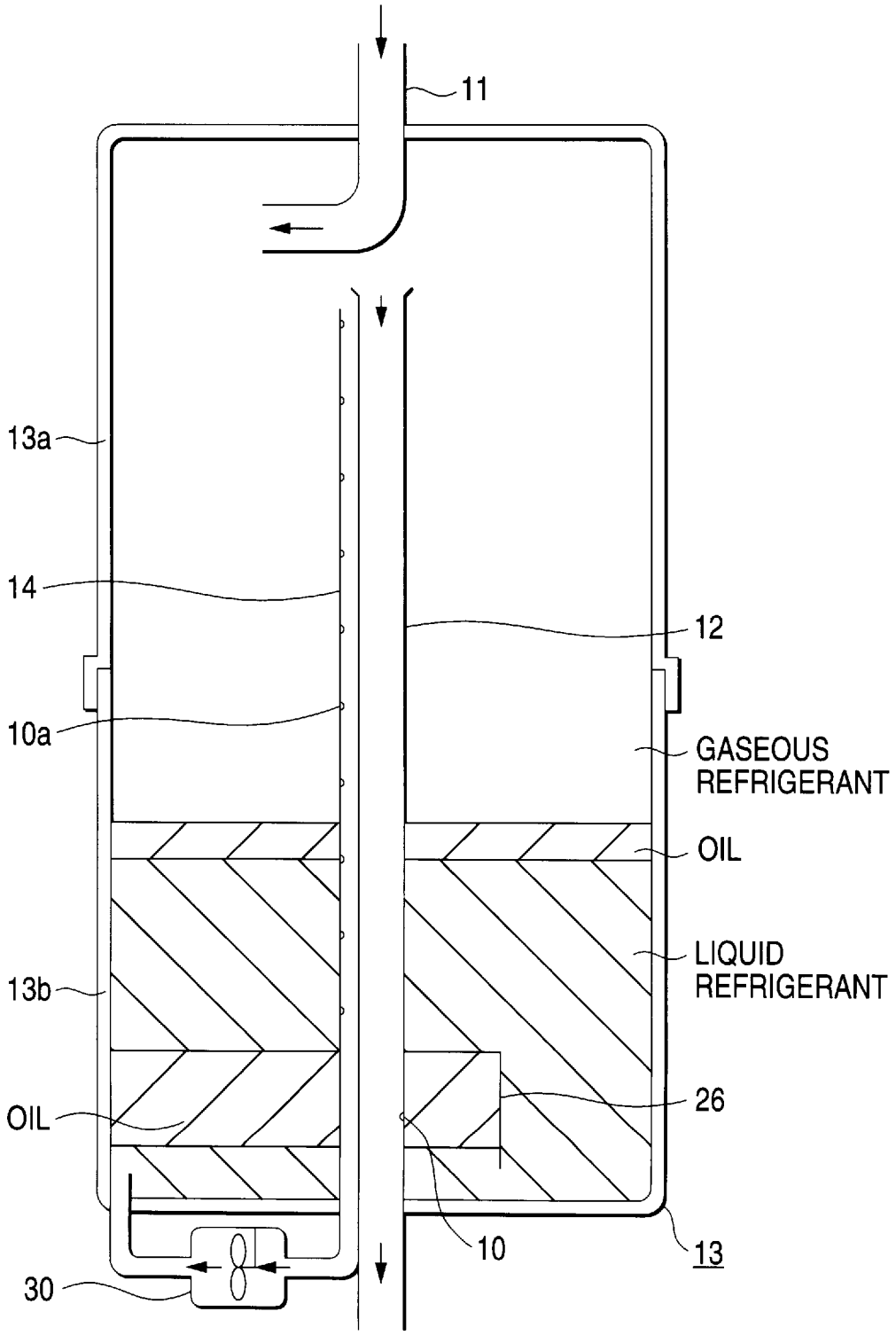
FIG. 4 is a diagram of an accumulator showing Embodiment 4.

A fourth embodiment will be described with reference to FIG. 4. In FIG. 4, a discharge pipe 12 and an auxiliary pipe 14 acting as an oil recovery pipe are fixed to each other by soldering. A number of oil recovery holes 10*a* are formed in the auxiliary pipe 14. This auxiliary pipe 14 is connected to a motor-driven pump 30, and returned from the motor-driven pump 30 into a cylindrical closed vessel 13 again. In addition, an oil reservoir vessel 26 is fixed to a cylindrical closed vessel lower portion 13*b* and the discharge pipe 12. An oil recovery hole 10 is provided in the discharge pipe 12.

Next, the operation will be described. Wet refrigerant flows into the cylindrical closed vessel 13 through the suction pipe 11, and liquid refrigerant and lubricating oil are collected in the vessel. When the lubricating oil is smaller in specific gravity than the liquid refrigerant so that the-lubricating oil is separated to float on the liquid refrigerant, the floating oil is drawn and recovered into the oil reservoir vessel 26 through any of the oil recovery holes 10*a*. At this time, the motor-driven pump 30 is driven to an extent that the oil can be recovered while the gas refrigerant in the auxiliary pipe 14 cannot be drawn into the oil reservoir vessel 26. Thus, the oil is drawn into the oil reservoir vessel 26 together with the liquid refrigerant. An oil layer is formed in the oil reservoir vessel 26, and the oil is returned to the compressor through the oil recovery hole 10 to thereby ensure the reliability of the compressor and prevent the compressor from being broken. In addition, in this embodiment, since a motor-driven pump is used as a method of drawing the oil into the oil reservoir vessel 26, a stable oil layer can be always formed in the oil reservoir vessel 26 regardless of the running conditions of the compressor and oil can be returned to the compressor stably.

The cylindrical closed vessel 13 is illustrated, the closed vessel is not always to be cylindrical. In addition, the diameter of the oil reservoir hole provided in the oil recovery pipe is designed to be large enough to have no problem in processing. Although the gas refrigerant hardly enters the auxiliary pipe 14 from the closed vessel 13 and hence hardly collected in the oil reservoir vessel 26 in the above-mentioned structure, gas refrigerant vent holes 26*a* may be provided to discharge the gas refrigerant into the cylindrical closed vessel 13 if gas refrigerant should be collected in the oil reservoir vessel 26.

Embodiment 5

Figure 5:
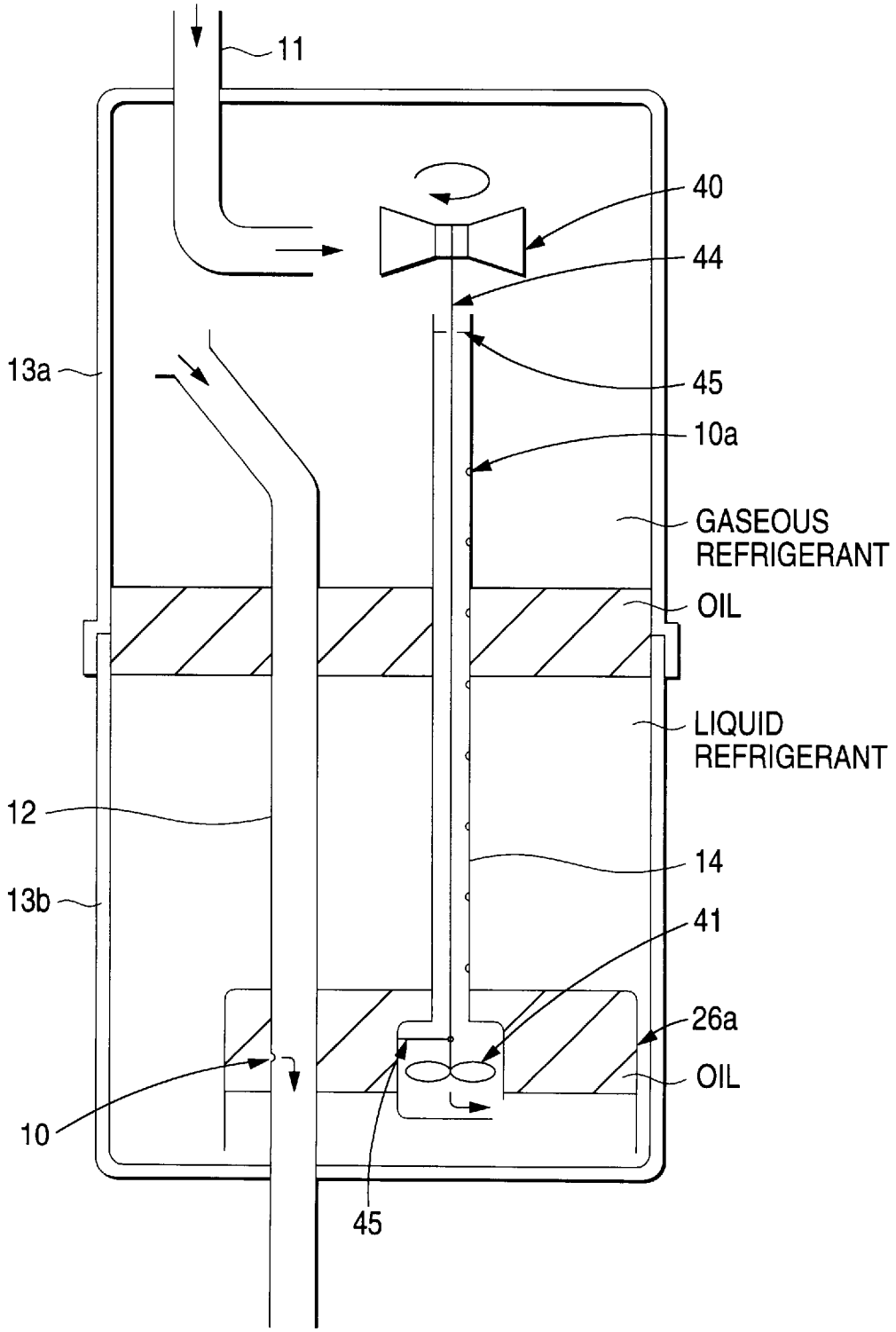
FIG. 5 is a diagram of an accumulator showing Embodiment 5.
Figure 6:
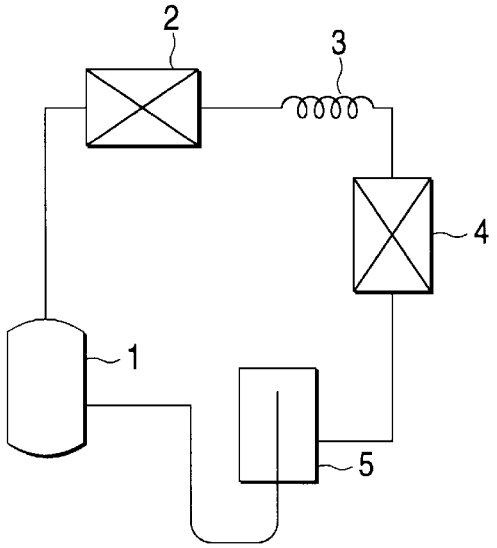
FIG. 6 is a diagram of a conventional refrigerating cycle.
Figure 7:
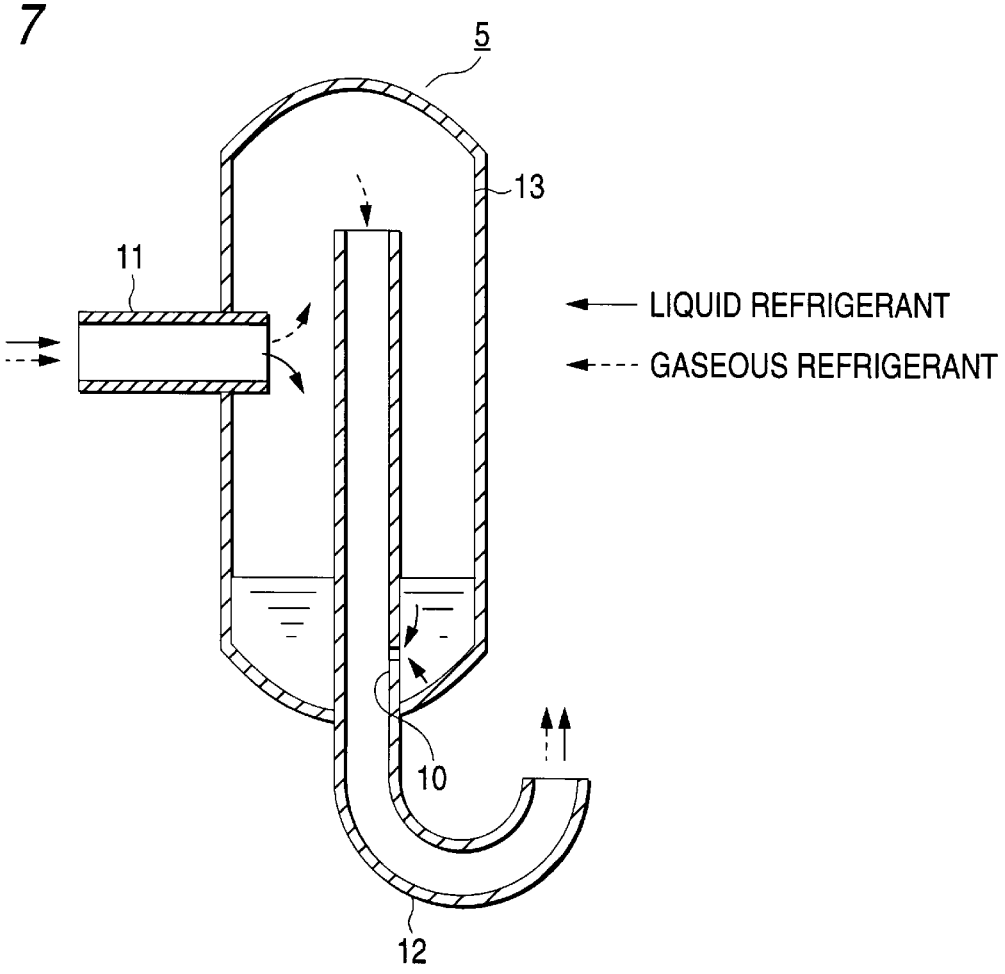
FIG. 7 is a sectional view of an accumulator in the conventional refrigerating cycle.

A fifth embodiment will be described with reference to FIG. 5. In FIG. 5, a shaft 44 supported at its upper and lower portions by bearings 45 penetrates the inside of an auxiliary pipe 14 acting as an oil recovery pipe. The auxiliary pipe 14 has a plurality of oil recovery holes 10*a*. Blades 40 driven by the flow of refrigerant supplied from a suction pipe 11 or driven by use of a pressure difference caused by the flow of refrigerant, and blades 41 for recovering floating oil are attached to the upper and lower ends of the shaft 44. When the blades 40 is driven, the blades 41 is rotated to introduce the refrigerant in the auxiliary pipe 14 into an oil reservoir vessel 26 without using any external power. At this time, the blades 40 and 41 are designed to generate an enough driving force to draw a liquid mixture of the oil and the refrigerant in a condition that gas refrigerant can not be introduced into the oil reservoir vessel 26. In addition, the oil reservoir vessel 26 is fixed to a discharge pipe 12, so that the oil collected in the oil reservoir vessel 26 is recovered through an oil recovery hole 10.

Next, the operation will be described. Wet refrigerant flows into the cylindrical closed vessel 13 through the suction pipe 11, and liquid refrigerant and lubricating oil are collected in the vessel. When the lubricating oil is smaller in specific gravity than the liquid refrigerant so that the lubricating oil is separated to float on the liquid refrigerant, the floating oil is drawn and recovered into the oil reservoir vessel 26 through any of the oil recovery holes 10*a*. According to this recovery method, the blades 40 are driven to rotate the blades 41, so that the refrigerant in the auxiliary pipe 14 is introduced into the oil reservoir vessel 26. In addition, the oil reservoir vessel 26 is fixed to the discharge pipe 12 so that the oil collected in the oil reservoir vessel 26 is recovered through the oil recovery hole 10 and returned to the compressor. An oil layer is formed in the oil reservoir vessel 26, and only the oil is returned to the compressor through the oil recovery hole 10 from the oil layer efficiently. Accordingly, the reliability of the compressor can be ensured and the compressor can be prevented from being broken.

The present invention arranged as has been described therefore has the following effects.

According to an aspect of the present invention, an accumulator comprises a closed vessel for storing a refrigerant circulating in a refrigerating cycle, a suction pipe for introducing the refrigerant into the closed vessel, a discharge pipe for discharging the refrigerant from the closed vessel, first and second oil recovery pipes held in the closed vessel and each having a plurality of oil recovery holes arranged in the vertical direction, and a communicating port through which the respective lower portions of the oil recovery pipes communicate with the discharge pipe. Accordingly, it is possible to reduce the quantity of liquid refrigerant returning to a compressor in comparison with the case of a single oil recovery pipe. The oil can be returned to the compressor by the quantity required for the compressor while the quantity of the liquid refrigerant returning to the compressor is reduced. It is therefore possible to ensure the reliability of the compressor, and prevent the compressor from being broken.

In addition, the first and second oil recovery pipes are provided in the vertical direction, and the positions of their oil recovery holes are made different. Accordingly, it is possible to cope with any height of the liquid level.

Further, a control valve for controlling the flow of the oil to be returned to the compressor in accordance with the running conditions of the compressor is provided in one of the first and second oil recovery pipes having oil recovery holes are disposed lower than the other oil recovery pipe. Accordingly, it is possible to control the quantity of the liquid refrigerant to be returned to the compressor.

Alternatively, according to another aspect of the present invention, an accumulator comprises a closed vessel for storing a refrigerant circulating in a refrigerating cycle, a suction pipe for introducing the refrigerant into the closed vessel, a discharge pipe for discharging the refrigerant from the closed vessel, an oil recovery pipe held in the closed vessel and having a plurality of oil recovery holes in the vertical direction, a communicating port through which the lower portion of the oil recovery pipe communicates with the discharge pipe, and a control valve provided in the oil recovery pipe for controlling the flow of oil to be returned to a compressor in accordance with the running conditions of the compressor. Accordingly, it is possible to control the flow of the oil to be returned to the compressor. It is therefore possible to ensure the reliability of the compressor, and prevent the compressor from being broken.

Further, the control valve is controlled in accordance with the outflow of oil from the compressor. Accordingly, it is possible to control the quantity of the lubricating oil to be returned to the compressor in accordance with the running conditions of the compressor.

Alternatively, according to a further aspect of the present invention, an accumulator comprises a closed vessel for storing a refrigerant circulating in a refrigerating cycle, a suction pipe for introducing the refrigerant into the closed vessel, an oil reservoir communicatable with the closed vessel, an oil recovery pipe held in the oil reservoir for sucking the refrigerant in the closed vessel from a plurality of oil recovery holes provided in the vertical direction, and introducing the refrigerant into the oil reservoir, a discharge pipe provided in the closed vessel for discharging the refrigerant dispersed in the closed vessel, and having an oil recovery hole within the oil reservoir. Accordingly, it is possible to recover the oil into the oil reservoir surely, and return the oil to the compressor.

Further, there is provided a driving means for sucking the refrigerant from the closed vessel through the oil recovery pipe and introducing the refrigerant to the oil reservoir. It is therefore possible to draw the oil into the oil reservoir to recover the oil surely, and return the oil to the compressor.

In addition, the oil reservoir is disposed above the oil recovery hole of the discharge pipe, and has a hole communicating with the closed vessel. Accordingly, it is possible to discharge surplus gas refrigerant into the closed vessel.

Being disposed outside the closed vessel, the driving means is easy in handling.

Since the driving means is driven by the flow of the refrigerant discharged from the suction pipe, external power is not necessary.

Since the discharge pipe is provided with a filter for recovering foreign matters, it is possible to prevent the oil recovery pipe from being blocked.

What is claimed is:

1. An accumulator comprising:

a closed vessel for storing a refrigerant which circulates in a refrigerating cycle;

a suction pipe for introducing said refrigerant into said closed vessel;

a discharge pipe for discharging said refrigerant from said closed vessel;

first and second oil recovery pipes each of which is held in said closed vessel and has a plurality of oil recovery holes formed in a vertical direction; and at least one communicating port through which lower portions of said oil recovery pipes communicate with said discharge pipe.

2. An accumulator according to claim 1, wherein said first and second recovery pipes are provided so that said oil recovery holes of said first and second recovery pipes are located at respective different positions in said vertical direction.

3. An accumulator according to claim 2, further comprising:

a control valve, provided in said second oil recovery pipe, for controlling flow quantity of oil to be returned to a compressor in accordance with running conditions of said compressor, said second oil recovery pipe having an oil recovery hole located at the lowest position in said vertical direction among all of said oil recovery holes of said first and second recovery pipes.

4. An accumulator comprising:

a closed vessel for storing a refrigerant which circulates in a refrigerating cycle;

a suction pipe for introducing said refrigerant into said closed vessel;

a discharge pipe for discharging said refrigerant from said closed vessel;

an oil recovery pipe held in said closed vessel and having a plurality of oil recovery holes formed in a vertical direction;

a communicating port through which a lower portion of said oil recovery pipe communicates with said discharge pipe; and a control valve, provided in said oil recovery pipe, for controlling flow quantity of oil to be returned to a compressor in accordance with running conditions of said compressor.

5. An accumulator according to claim 4, wherein said control valve is controlled in accordance with flow quantity of oil discharged from said compressor.

6. An accumulator comprising:

a closed vessel for storing a refrigerant which circulates in a refrigerating cycle;

a suction pipe for introducing said refrigerant into said closed vessel;

an oil reservoir provided at a lower portion of said closed vessel and within said closed vessel so that a lower portion of said oil reservoir can communicate with said closed vessel;

an oil recovery pipe held in said oil reservoir for sucking said refrigerant out of said closed vessel through a plurality of oil recovery holes formed in a vertical direction, and introducing said refrigerant into said oil reservoir;

a discharge pipe fixed in said closed vessel for discharging said refrigerant dispersed in said closed vessel, said discharge pipe having an oil recovery hole located within said oil reservoir.

7. An accumulator according to claim 6, further comprising:

driving means for sucking said refrigerant out of said closed vessel through said oil recovery pipe and introducing said refrigerant to said oil reservoir.

8. An accumulator according to claim 6 or 7, wherein said oil reservoir has a hole that is located at an upper position in said vertical direction relative to said oil recovery hole of said discharge pipe, and that communicates with said closed vessel.

9. An accumulator according to claim 7, wherein said driving means is provided outside said closed vessel.

10. An accumulator according to claim 7 or 9, wherein said driving means is driven by flow of said refrigerant discharged from said suction pipe.

11. An accumulator according to any one of claims 1–7, and 9, wherein said discharge pipe is provided with a filter for recovering foreign matters.

12. An accumulator comprising:

a closed vessel for storing a refrigerant which circulates in a refrigerating cycle;

a suction pipe for introducing said refrigerant into said closed vessel;

a discharge pipe for discharging said refrigerant from said closed vessel;

a first oil recovery pipe held in said closed vessel and generally separated from said discharge pipe;

a plurality of oil recovery holes provided in said oil recovery pipe and arranged in a vertical direction so that oil accumulated at varying vertical position within said closed vessel can be introduced into said oil recovery pipe; and means for introducing said oil from said oil recovery pipe into said discharge pipe.

13. An accumulator according to claim 12, wherein said means includes a communicating port through which a lower portion of said oil recovery pipe communicates with said discharge pipe.

14. An accumulator according to claim 12, further comprising a second oil recovery pipe having a plurality of second oil recovery holes arranged in said vertical direction, wherein said first and second oil recovery holes are located at respective different positions in said vertical direction.

15. An accumulator according to claim 12, wherein said means includes:

an oil reservoir provided within said closed vessel so as to communicate with said oil recovery pipe; and a hole formed in said discharge pipe and located within said oil reservoir.

16. An accumulator according to claim 12, wherein said means includes:

an oil reservoir provided within said closed vessel;

a hole formed in said discharge pipe and located within said oil reservoir; and a pump for introducing said oil from said oil recovery pipe to said oil reservoir.

* * * * *